United States Patent [19]

Machacek

[11] 4,198,086

[45] Apr. 15, 1980

[54] GATE LATCHING DEVICE

[76] Inventor: LaVerne D. Machacek, Box 304, Eureka, Nev. 89316

[21] Appl. No.: 883,737

[22] Filed: Mar. 6, 1978

[51] Int. Cl.[2] ..... E05C 17/36

[52] U.S. Cl. ..... 292/246; 160/328

[58] Field of Search ..... 292/246, 247, 264; 49/34; 160/328

[56] References Cited

U.S. PATENT DOCUMENTS

| | | | |
|---|---|---|---|
| 2,827,265 | 3/1958 | McKillop | 160/328 X |
| 3,473,598 | 10/1969 | Winter et al. | 292/246 X |
| 3,606,427 | 9/1971 | O'Loughlin | 292/307 R |

*Primary Examiner*—Richard E. Moore

*Attorney, Agent, or Firm*—Daniel Jay Tick

[57] ABSTRACT

A gate latch device consists of a length of chain coupled to a gate post and wound on a drum rotatably mounted on a fence post adjacent the gate. The chain draws the gate into closed position in the fence as the drum is manually rotated.

2 Claims, 3 Drawing Figures

GATE LATCHING DEVICE

BACKGROUND OF THE INVENTION

The present invention relates to a gate latching device. More particularly, the invention relates to a gate latching device for a fence having a pair of spaced fence posts defining a gate area and a gate having spaced first and second gate posts, the first gate post being hingedly affixed to one of the fence posts and the second gate post being next-adjacent the other of the fence posts when the gate is closed.

Gate latching devices are disclosed in U.S. Pat. Nos. 499,279; 593,060; 807,591; 919,705; 2,743,125 and 2,827,265.

Objects of the invention are to provide a gate latching device of simple structure, which is inexpensive in manufacture, installed with facility and convenience on any fence, new or otherwise, used with facility and convenience, and functions efficiently, effectively and reliably to close and secure a gate in closed position.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
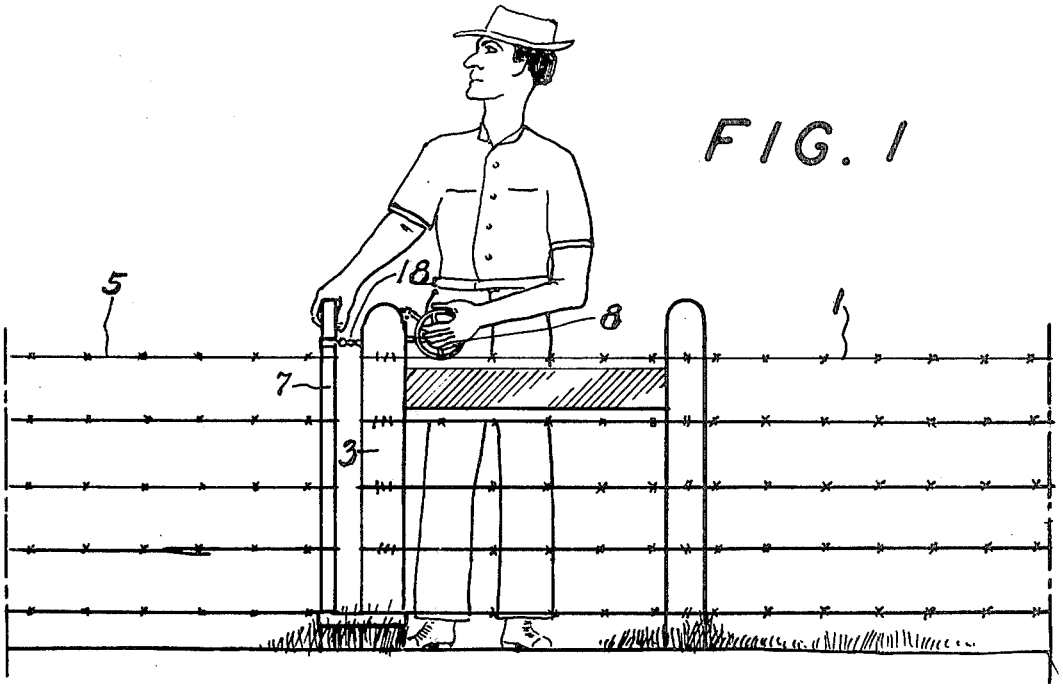
FIG. 1 is a view of an embodiment of the gate latching device of the invention in use.
Figure 2:
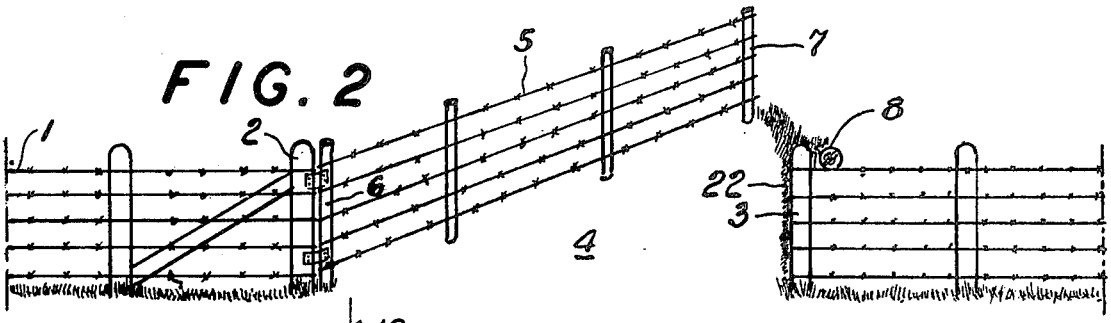
FIG. 2 is a view of an open gate in a fence having the embodiment of FIG. 1 mounted on the fence.

The gate latching device of the invention is for a fence 1 having a pair of spaced fence posts 2 and 3 defining a gate area 4, as shown in FIG. 2. The fence 1 has a gate 5 having spaced first and second gate posts 6 and 7, respectively, as shown in FIG. 2. The first gate post 6 is hingedly affixed to the fence post 2, as shown in FIG. 2. The second gate post 7 is next-adjacent the other fence post 3 when the gate 5 is closed, as shown in FIGS. 1 and 3.

Figure 3:
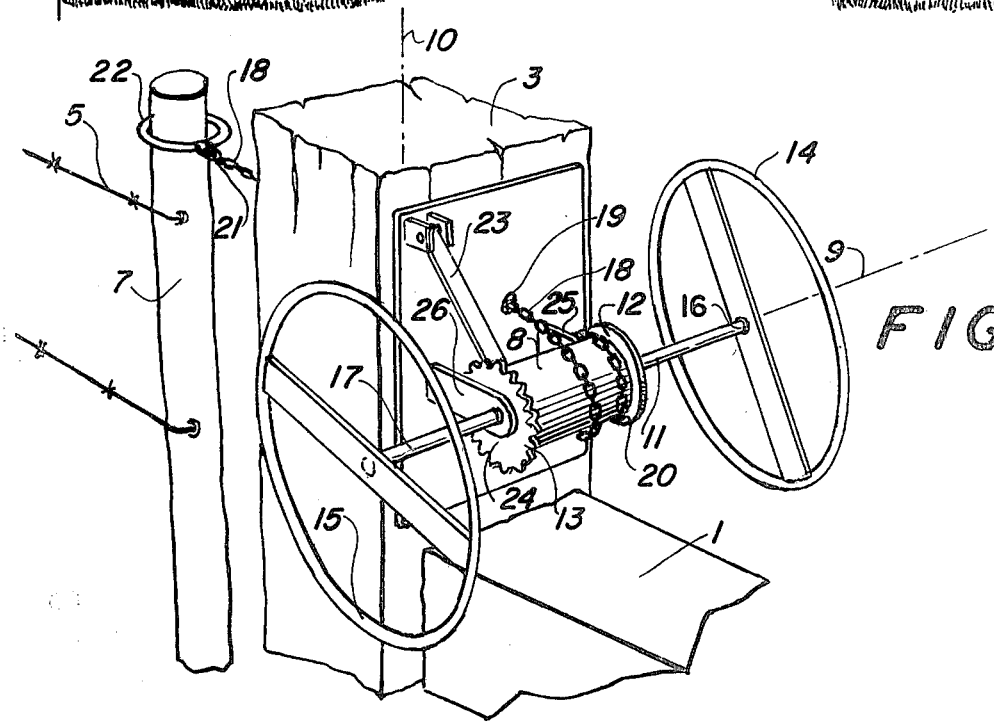
FIG. 3 is a perspective view, on an enlarged scale, of the embodiment of FIGS. 1 and 2 of the gate latching device of the invention.

The gate latching device of the invention comprises a drum 8 rotatably mounted on the fence post 3 for rotation about its axis 9 (FIG. 3). The axis 9 of the drum 8 is perpendicular to the axis 10 (FIG. 3) of the fence post 3.

A rod 11 extends coaxially through the drum and beyond the opposite ends 12 and 13 thereof, as shown in FIG. 3. The rod 11 is affixed to the drum 8.

A pair of turning wheels 14 and 15 are provided, as shown in FIG. 3. The turning wheel 14 is affixed to an end 16 of the rod 11 and the turning wheel 15 is affixed to the spaced opposite other end 17 of said rod to facilitate manual rotation of the drum 8.

A length of chain 18 (FIGS. 1 and 3) extends through a bore 19 formed through the fence post 3, as shown in FIG. 3. The length of chain 18 has spaced opposite first and second ends 20 and 21, respectively, as shown in FIG. 3. The first end 20 of the chain 18 is affixed to the drum 8, as shown in FIG. 3, whereby said chain is selectively windable on said drum and unwindable from said drum.

A ring 22 (FIGS. 2 and 3) is affixed to the second end 21 of the chain 18 and fitable around the second gate post 7 of the gate 5 whereby when said ring is positioned around said second gate post, as shown in FIG. 3, and the drum 8 is rotated, the gate 5 is closed and secured in closed position.

A ratchet 23 is mounted on the fence post 3 and a pinion 24 is affixed to, and rotatable with, the drum 8, as shown in FIG. 3. The pinion 24 cooperates with the ratchet 23 to secure the drum 8 in position each time it is rotated. The ratchet 23 is manually releasable from the pinion 24 when it is desired to release the chain.

The drum 8 is rotatably mounted on the fence post 3 via a pair of spaced parallel arms 25 and 26 extending from said gate post, as shown in FIG. 3.

While the invention has been described by means of a specific example and in a specific embodiment, I do not wish to be limited thereto, for obvious modifications will occur to those skilled in the art without departing from the spirit and scope of the invention.

I claim:

1. A combination of a fence having a pair of spaced fence posts defining a gate area and a gate having spaced first and second gate posts, the first gate post being hingedly affixed to one of the fence posts and the second gate post being next-adjacent the other of the fence posts when the gate is closed; and a gate latching device comprising a drum rotatably mounted on the other of the fence posts for rotation about its axis, the axis of the drum being perpendicular to the axis of said fence post, a rod extending coaxially through the drum and beyond the opposite ends thereof and affixed to said drum, a pair of turning wheels each affixed to a corresponding end of the rod to facilitate manual rotation of the drum, a length of chain extending through a bore formed through said other of said fence posts and having mutually spaced opposite first and second ends, the first end of the chain being affixed to the drum whereby said chain is selectively windable on the drum and unwindable from said drum, and a ring affixed to the second end of the chain and fitable around the second gate post of the gate whereby when the ring is positioned around said second gate post and the drum is rotated the gate is closed.

2. A gate latching device as claimed in claim 1, further comprising a ratchet mounted on said other fence post and a pinion affixed to and rotatable with the drum and cooperating with said ratchet to secure said drum in position each time it is rotated, said ratchet being manually releasable from said pinion.

* * * * *